US007829775B2

(12) United States Patent
Morrow

(10) Patent No.: US 7,829,775 B2
(45) Date of Patent: Nov. 9, 2010

(54) NECKED STRING INSTRUMENT SUPPORT PARTICULARLY SUITED FOR A GUITAR

(76) Inventor: Marvin Morrow, 75-419 La Cresta Dr., Palm Desert, CA (US) 92211

( * ) Notice: Subject to any disclaimer, the term of this patent is extended or adjusted under 35 U.S.C. 154(b) by 0 days.

(21) Appl. No.: 12/465,076

(22) Filed: May 13, 2009

(65) Prior Publication Data

US 2009/0282963 A1 Nov. 19, 2009

Related U.S. Application Data

(60) Provisional application No. 61/053,543, filed on May 15, 2008, provisional application No. 61/129,403, filed on Jun. 24, 2008.

(51) Int. Cl.
*G10D 3/00* (2006.01)

(52) U.S. Cl. ..... 84/327

(58) Field of Classification Search ..... 84/453, 84/327, 329; 206/314; 248/443, 309.1; 224/910
See application file for complete search history.

(56) References Cited

U.S. PATENT DOCUMENTS

| | | | | |
|---|---|---|---|---|
| D281,576 | S | 12/1985 | Akers | |
| 5,911,396 | A | 6/1999 | Bireley | |
| 6,191,347 | B1 | 2/2001 | Hoshino | |
| 6,231,018 | B1 | 5/2001 | Barbieri | |
| 6,281,417 | B1 | 8/2001 | Ladao | |
| 6,685,283 | B2 | 2/2004 | Gembar et al. | |
| 7,090,313 | B1 | 8/2006 | McMurray | |
| 7,375,269 | B2 | 5/2008 | Perkins | |
| 7,547,835 | B1 * | 6/2009 | Mayor | 84/327 |
| 2003/0214202 | A1 | 11/2003 | Gembar et al. | |

* cited by examiner

*Primary Examiner*—Kimberly R Lockett

(57) ABSTRACT

A novel display and storage hanger for a musical instrument, and particularly, a guitar which provides for user unobtrusive, secure mounting at a selected angular rotation to achieve a desired display or storage position.

19 Claims, 6 Drawing Sheets

NECKED STRING INSTRUMENT SUPPORT PARTICULARLY SUITED FOR A GUITAR

This application claims the benefit of U.S. provisional application Ser. Nos. 61/053,543, filed on May 15, 2008 and 61/129,403, filed on Jun. 24, 2008, which are incorporated herein by reference.

I. BACKGROUND OF THE INVENTION

This invention relates to an improvement to wall mounting of a stringed instrument with a neck and a body featuring strap pins, and more particularly, to guitar supports and their use.

II. DESCRIPTION OF THE TECHNICAL FIELD

Presently, conventional guitar holders are designed to hold and support a suspended guitar from the neck. Nearly all holders/hangers are made to hold the guitar by the neck, at the junction of the headstock, which is probably the most vulnerable part of the guitar. When a guitar structure does break, most commonly it is at the junction of the neck and headstock. Conventional holders do nothing to reduce stress on this junction. Indeed, by supporting the guitar exclusively by the neck/headstock, and universally with a vertical orientation the standard guitar holder exposes the instrument to a high risk of damage.

Regardless of being electric or acoustic, guitars consist primarily of two discrete segments, the body and the neck, each essentially supporting one end of the strings. Although a number of variables exist from guitar to guitar, guitars also share other common features such as strap buttons or pins on opposite ends of the body itself, to allow the musician to support the guitar across a shoulder.

As for the location of the strap buttons, (assuming a vertical angle view of the instrument), one is positioned at the bottom (base) of the body and the other generally located at the other end of the body (shoulder), to one side or the other of the neck. The buttons are typically secured by screwing them into the wood body. Other variations apply as well, (such as Gibson SG, where the pins are at the base, and on the back of the guitar near the neck or on a cutaway "fin"). When strap buttons are affixed to an acoustic guitar, the preferred attachment location is commonly where the hollow body incorporates some reinforcement, e.g., with internal ribs to minimize the risk of damaging or splitting the wood. Electric guitars/basses may be hollow bodied, the type preferred by jazz musicians or may be semi-hollow or most commonly, constructed with a solid body. If hollow or semi-hollow, placement of the buttons preferably is at a location which includes some reinforcement. A solid body dispenses with the need for such reinforcement.

The invention herein contemplates a support that holds the guitar by way of the strap pins and permits user selection of the mounting angle.

III. SUMMARY OF THE INVENTION

It is, therefore, an object of the present invention to address and overcome problems of the prior art hangers and methods.

It is another object of this invention to provide an efficient, efficacious, and improved instrument display system.

Another object of this invention is to provide a generally unobtrusive and nearly invisible during front viewing which is a simple, attractive, and functional alternative to prior art instrument hangers.

A further object of the invention provides novel guitar display hardware usable in a retail environment.

It is still another object of the invention to improve the quality of necked string instrument display and storage that minimizes the risk of damage to the instrument.

Still another object of the invention is to provide a secure and simple structure for and method of user configurable mounting a guitar by its strap pins.

These and other objects are satisfied by a supporting bracket for an article with spaced, projecting retaining pins, comprising: a mounting base for attachment to a selected structural surface, a first element of a interlockable rotatable member having a inward face and an outward face, the outward face incorporating the first member of a cooperating interlocking structure, said first element being connected to and overlying the mounting base; a second element of a interlockable rotatable member having a inward face and an outward face, the inward face incorporating the second member of a cooperating interlocking structure, said second element being interlockable with and overlying said first element; a mounting bracket including a central hub, a pair of arms extending outwardly away from the hub where each arm includes a pin retaining opening, said mounting bracket being connected to the mounting bracket, the first element and the second element; in a manner to overlie the second element; and a compression element to apply compressive force to the central hub of the mounting bracket, the second element, the first element, and the mounting base in a manner to interlock the first and second elements and prevent their relative rotation.

These and other objects are also satisfied by a hanger bracket for support of a necked string instrument having strap buttons, comprising: a base plate member attachable to a select surface; an instrument retaining member including slots dimensioned to receive and retain the strap buttons; a pin having a first end connected to the base member and a second threaded end, said instrument retaining member being mounted on the pin between the first and second ends; a clamping member threaded on the pin and movable axially therealong between a first position and a second position; a first element of a interlockable member having a inward face and an outward face, the outward face incorporating the first member of a cooperating interlocking structure, said first element associated with the base plate member; and a second element of a interlockable member having a inward face and an outward face, the inward face incorporating the second member of a cooperating interlocking structure, said second element associated with the instrument retaining member; wherein said first and second elements are rotatable about the pin and permit relative rotation of the base member and instrument retaining member when the clamping member is in the first position and where said first and second elements are interlocked when said clamping member is in the second position to thereby prevent rotation of the base plate member relative to the instrument retaining member.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawing, and which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

Given the following detailed description, it should become apparent to the person having ordinary skill in the art that the invention herein provides a significantly improved musical instrument support bracket that mitigate the risk of instrument damage from its use.

IV. BRIEF DESCRIPTION OF THE DRAWINGS

Figure 8:
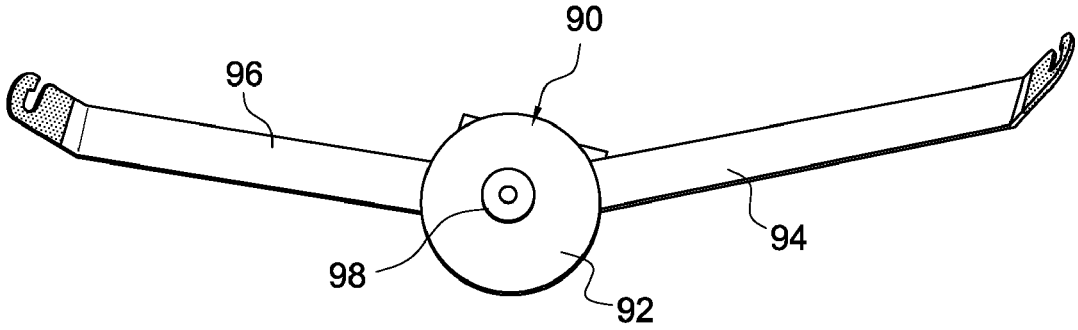
FIG. 8 is a front view of a further embodiment of the invention also adapted for slat wall mounting.
Figure 9:
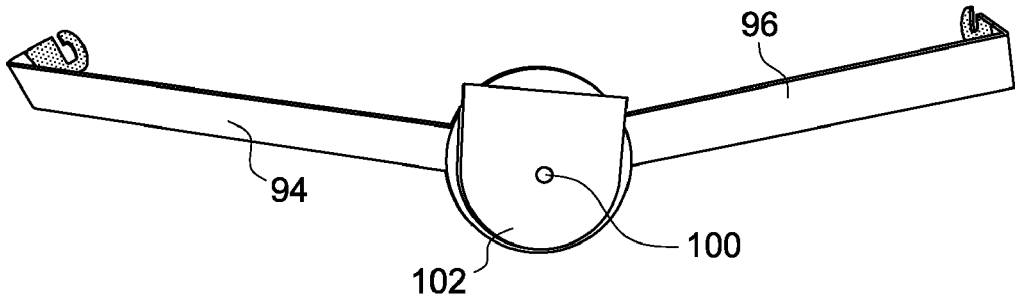

FIG. 9 a back view of the embodiment of the invention illustrated in FIG. 8.

Figure 10:
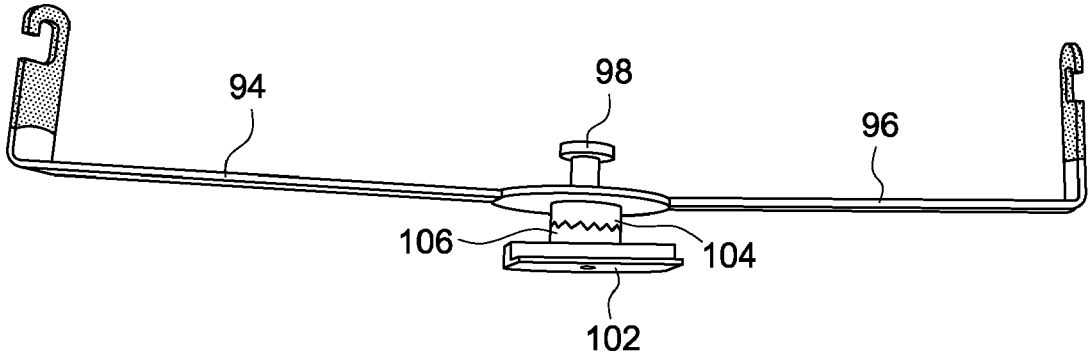

FIG. 10 a top view of the embodiment of the invention illustrated in FIG. 8.

Figure 11:
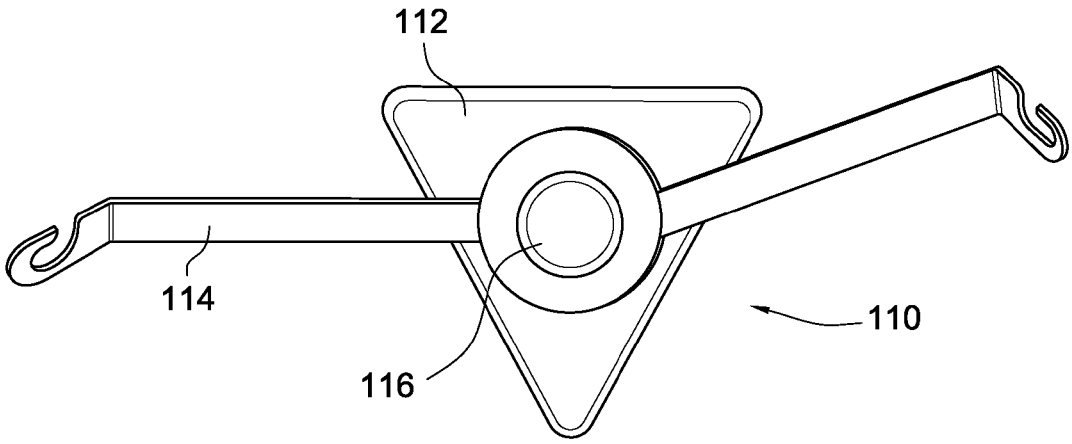

FIG. 11 a front view of a fifth embodiment of the invention including a triangular wall mounting plate.

Figure 12:
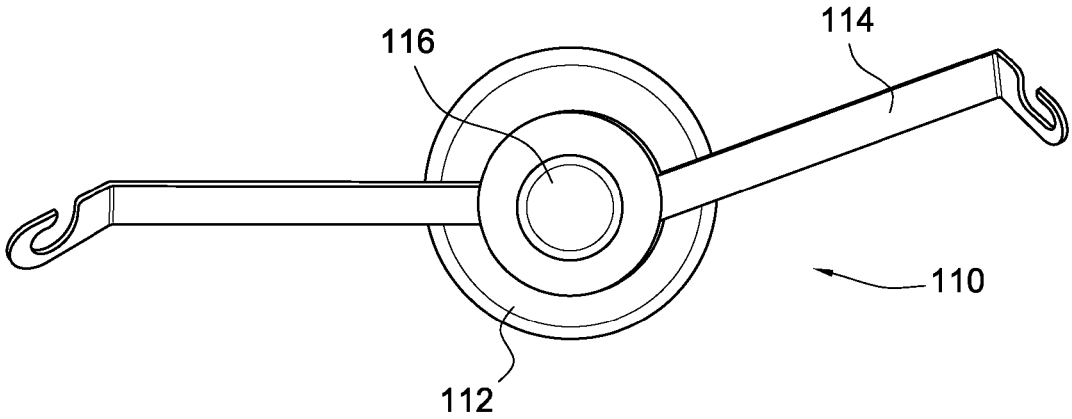

FIG. 12 a front view of a sixth embodiment of the invention having a circular wall mounting escutcheon.

Figure 13:
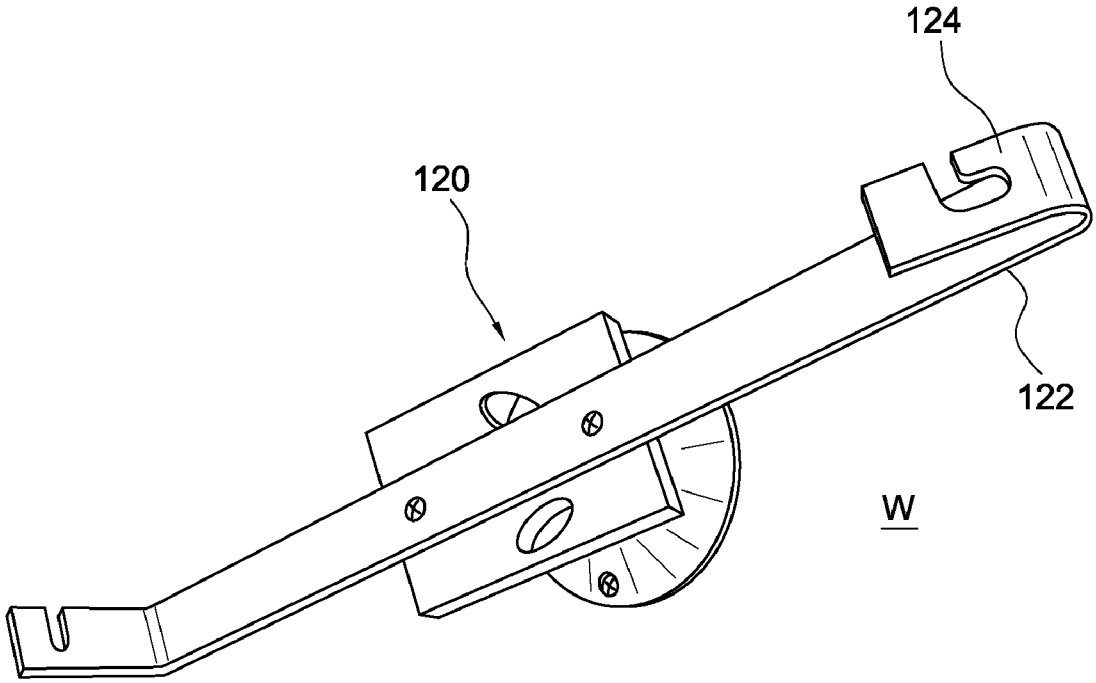

FIG. 13 is a front view of an embodiment conforming to a guitar with a back pin.

V. DETAILED DESCRIPTION OF THE ILLUSTRATED EMBODIMENTS

The novel features which are believed to be characteristic of the present invention, as to its structure, organization, use and method of operation, together with further objectives and advantages thereof, will be better understood from the drawings in which embodiments of the invention will now be illustrated by way of example. It is expressly understood, however, that the drawings are for the purpose of illustration and description only and are not intended as a definition of the limits of the invention. Embodiments consistent with the accompanying drawings are within the scope of this invention.

Figure 1A:
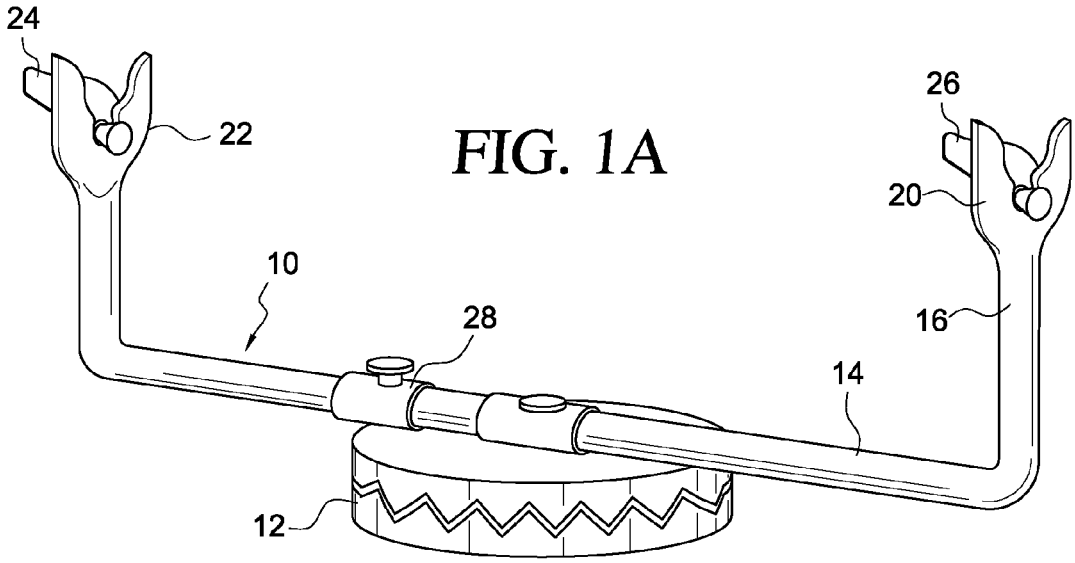
FIG. 1A is a perspective view of a first embodiment of the invention.
Figure 1B:
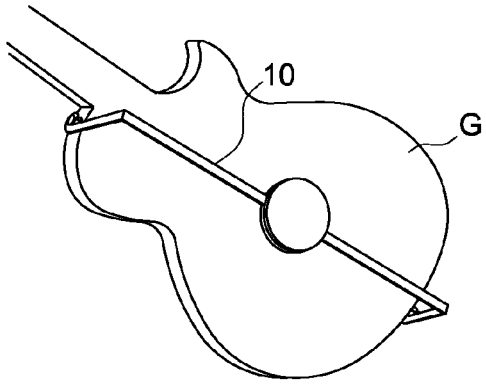
FIG. 1B is a partial rear perspective view of the embodiment of FIG. 1 in assembly with a guitar (Fender Strat/dbl cutaway style).
Figure 1C:
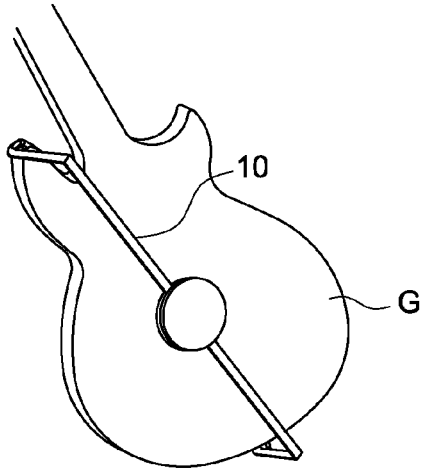
FIG. 1C is a partial rear perspective view of the embodiment of FIG. 1 in assembly with the front of a guitar (Les Paul single cutaway style).
Figure 1D:
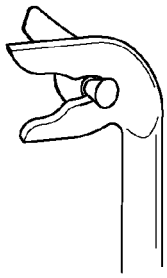
FIG. 1D is a detail view of a pin latch assembly of the embodiment of FIG. 1.
Figure 1E:
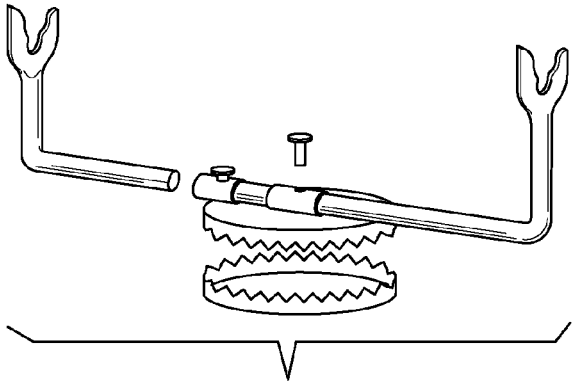
FIG. 1E is an assembly view of the embodiment of FIG. 1.

Referring to FIGS. 1A-E, The pivotable guitar hanger 10 includes a base member 12 that may be bifurcated and include conventional serrations for aligning the respective portions in a desired position. Mounted to the base member 12 is an elongate spanning support rod 14 which, if desired may be telescopic to provide for length adjustment with lock 28. At each end of the spanning rod 14 are legs 16 and 18 projecting generally parallel to each other and orthogonally from the axis of the spanning support rod 14. The length of the legs must provide adequate depth for the mount 10 to secure the target guitar G by its strap pins. Strap pin latch assemblies 20 and 22 are formed at the projecting ends of the legs 16 and 18. As illustrated, the assemblies respectively include pivotal, spring bias closed, pin latches 24 and 26 adapted to releasably engage the guitar pins on each end of the body of the guitar (base & shoulder). FIG. 1E illustrates a very a basic form of the invention having a circular mounting base positionable by using a screw.

Figure 2:
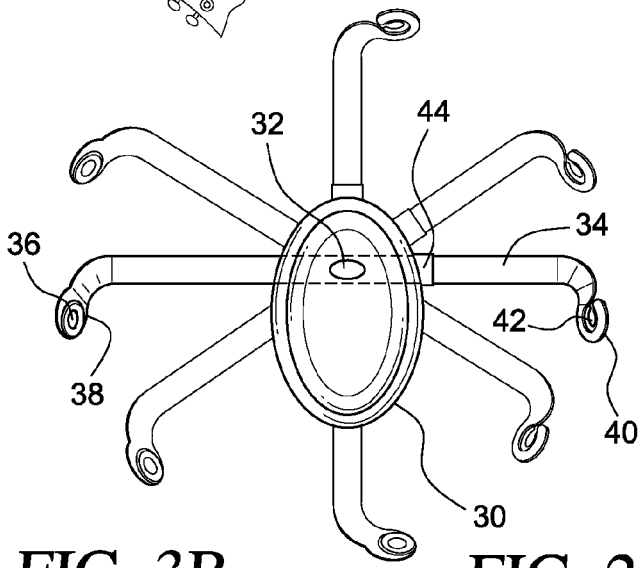
FIG. 2 is a front view of a wall mountable alternative embodiment of the invention with ghost lines representing different rotational orientation of the supporting arm.

FIG. 2 represents a further embodiment of the invention showing an oval wall mount 30 for fastening directly to a wall by appropriate means. Preferably, the upper surface of the wall mount incorporates a soft pillow pad 31 of appropriate material (e.g., non-acidic) on which the back of the guitar will rest and will protect the guitar and its finish during disturbances such as minor earthquakes or even transport. The mount 30 includes a thumbscrew attachment 32 to permit adjustment of the angle of rotation of the support bar 34 which is illustrated in ghosted form in four different positions. In this embodiment, the guitar strap pin engaging structure at the body engaging side of the arm 34 is a fitted hole 36 including a resilient washer 38 for securing to the pin on the guitar body. At the opposite end, the shoulder strap pin engaging latch is a pin slot 40 including a washer/resilient protective liner 42 for slidably engaging the neck strap pin. So as to provide versatility, the rotatable support bar also features a telescoping length adjustment functionality that is releasably adjustably by loosening and tightening collar 44.

Figure 3A:
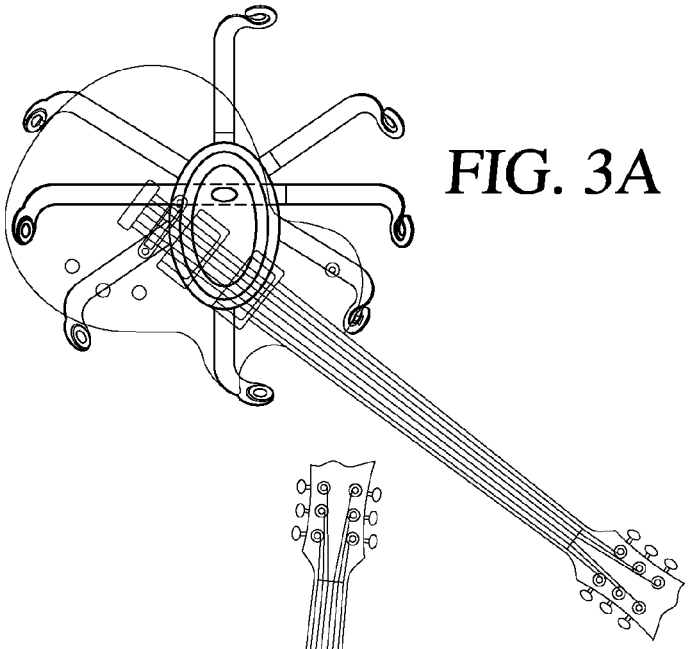
FIG. 3A is a schematic view of the embodiment of FIG. 2 with a ghosted guitar mounted at a downward angle.
Figure 3B:
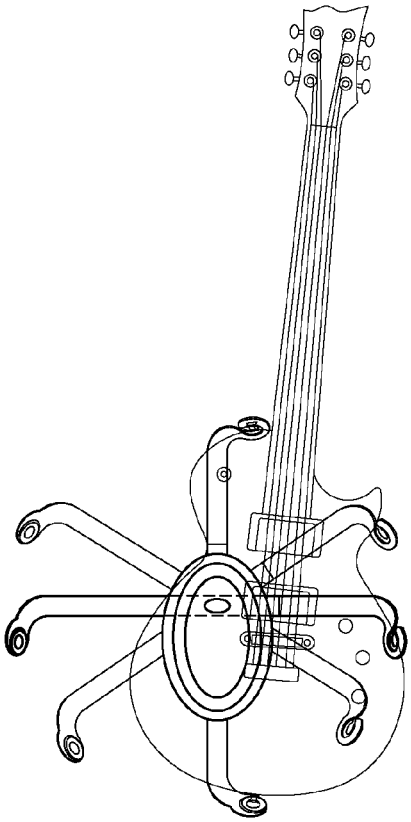
FIG. 3B is a schematic view of the embodiment of FIG. 2 with a ghosted guitar mounted vertically.
Figure 3C:
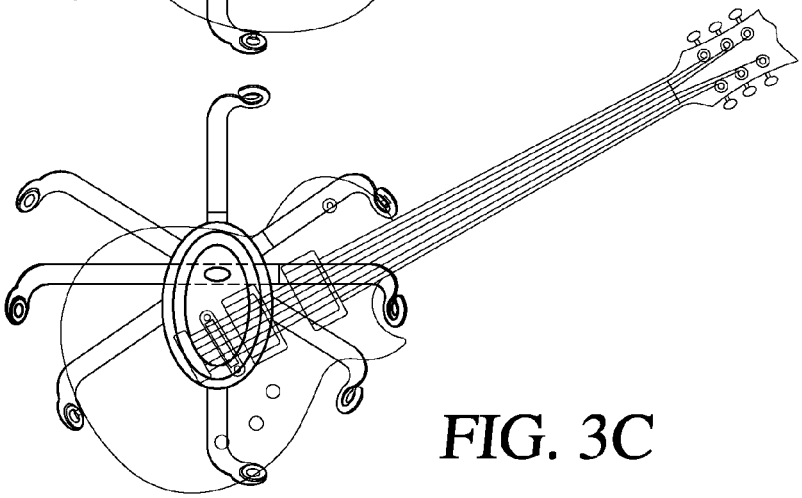
FIG. 3C is a schematic view of the embodiment of FIG. 2 with a ghosted guitar mounted at an upward angle.

FIGS. 3A-C depict in ghosted form selective positioning of an electric guitar using the invention. Rotational adjustment is achieved by loosening the thumbscrew 32, rotating the arm to a position corresponding to the desired hanging position of the guitar and tightening the screw so as to positionally fix the arm. As indicated above, the length of the arm is adjustable using the collar 44.

The embodiment of the invention illustrated in FIGS. 1A-E is suitable for mounting a conventional acoustic guitar. The drawing also sketches out a wall mounting arrangement that permits user selected angling of the supported guitar when mounted on a wall. The drawings of FIG. 2 and FIG. 3A-C illustrate another embodiment of the inventive guitar mounting invention in association with an electric guitar.

Figure 4:
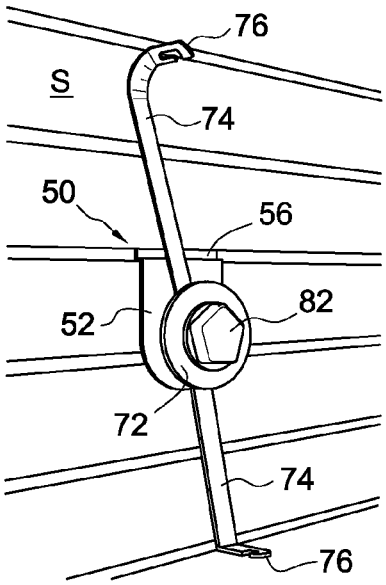
FIG. 4 is a perspective view of a slat wall display embodiment of the invention.
Figure 5:
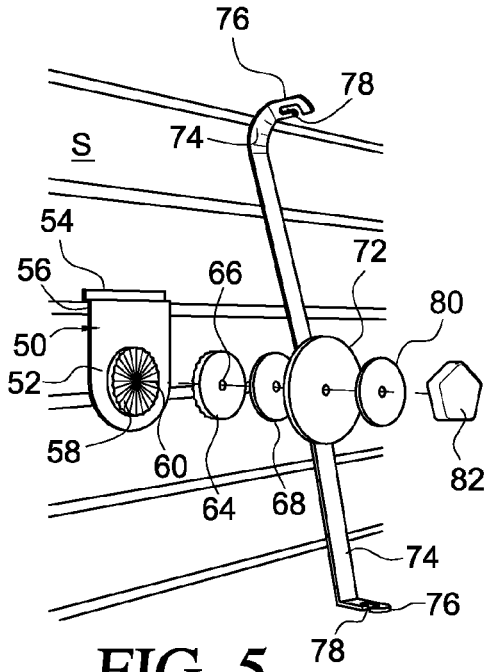
FIG. 5 is an exploded assembly view of the embodiment of FIG. 4.

In FIGS. 4 and 5 is illustrated an embodiment of the invention adapted particularly for mounting the instrument supporting bracket on slat walls so commonly used in retail music stores. In this embodiment, the invention resides not only in the guitar mount but also in providing more broadly, a new slat wall mounting display clamp structure.

Slat wall engaging instrument supporting bracket clamp 50 includes a generally base plate 52 of a selected planar dimensions sufficient to lie on the face of the slat wall S. From the upper edge base plate 52 and offset therefrom is an upwardly protruding engagement lip 54 of a height selected for insertion through the gaps between the slats to lodge firmly behind the overlying slat and provide for stable mounting to the slat wall. The engagement lip 54 is connected to the base plate 52 by an intermediate horizontal portion 56 forming an L-shaped configuration. The horizontal portion 56 is sized to correspond in depth of the slat wall from which the vertically disposed engagement lip 54 extends upwardly a sufficient distance to permit secure engagement with the slat wall.

In the illustrated embodiment, centrally mounted to the face of the base plate 52 is a round first engaging disk element 58 of a rotatable coupling connector. This element preferably is positionally affixed on the base plate 52 to prevent movement relative thereto and features a central bore for receiving a pin/axle 60. (This may be an elongated screw) which itself is affixed or secured to the mounting plate 52 in a manner to project orthogonally from its planar surface of the mounting member to pass through the bore of the first engaging disk element 58. The outwardly facing surface of the disk element 58 features a rotational restricting element, in this case, radially disposed teeth 62. While illustrated as a separate element, this first engaging element may be formed on and as an integral part of the base plate 52. Dimensioned to overlie, clamp against, and co-act with the first disk element 58 is second disk element 64. The inwardly facing surface of element 64 includes a complementary rotational restricting element corresponding to that of the first engaging disk element 58. The disk element 64 includes a central bore 66 that is slidably mounted on the pin/axle 60 in a manner to permit rotation thereon when not clampingly engaged to the disk element 58.

As illustrated, the engaging element comprises radially disposed teeth on the opposing faces of the first and second disk elements. This construction is believed to provide for the most rugged and secure interlocking. However, the rotational restricting elements of the disk elements 58 and 64 may take other forms such as a series of circularly disposed, spaced coating apertures and pins that prevent relative rotation therebetween when clamped together. Other constructions may be also be used so long as the construction permits the rotational restricting element of the second opposed engaging element to co-act with and prevent relative rotation between the second disk element and the base plate 52.

A washer 68 with a center hole is positioned on the pin/axle 60 and overlies the outwardly facing surface of the second disk element 64. Preferably the washer is formed from a felt material that serves to dampen forces (vibrational, shock etc.) to the mounted guitar. A mounting bracket 70 with a center hole is then secured over the pin/axle 60. The guitar mounting bracket 70 features a central flat hub 72 with an inwardly facing surface that abuts the washer 68, a pair of bracket arms 74 with projecting fingers 76. In this embodiment, the bracket 70 is not adjustable and therefore is essentially customized for specific guitar models corresponding to the fixed dimensions. Preferably, it is formed from a single piece of a strong, rigid and attractive material, e.g., machined, brushed aluminium but may be constructed of any material suitable to satisfy the necked instrument (guitar) supporting function of the invention, i.e., engineered plastics.

Referring to the structure of arms 74 and projecting fingers 76, they respectively extend laterally and outwardly from the hub a distance specific to the location of the guitar strap buttons/pins. The fingers 76 feature pin/buttons retaining slots 78 dimensioned to slidably receive and secure the strap pin/buttons. As mentioned in reference to FIG. 2, the terminal ends of the fingers incorporating the slots 78 may include a plastic heat shrink covering to protect against damage to the guitar body during engagement of the pin/buttons P in the slots. Other non-erosive materials may be used such as felt, fur, etc. Another washer 80 made from felt or some other appropriate non-scratching, resilient material, is mounted on the pin/axle 60 and rests against the outwardly facing hub surface.

Fastened by the threading at the outer end of the pin/axle 60 is thumbscrew knob 82. It is threadingly mounted on the end of the pin/axle 60 to provide, upon tightening, compressive force against the washer 80, the hub 72 and, therefore, the remaining underlying elements. Thumbscrew knob 82 may possess any desired geometric configuration and be formed of metal, plastic or wood to satisfy aesthetics. Its thickness however, may not exceed the length of the projection of the finger 78 in order to provide sufficient clearance between its outer face and a guitar body when mounted to the bracket. When the knob is loosened to a degree to disengage the rotation restrictive elements of the first and second disks to allow rotation therebetween, the angular disposition of the bracket arms 74 may be altered according to the user's preference. Once the user has chosen a selected angular disposition, the thumbscrew knob is rotated to bear against the washer 80, hub 72 and underlying disks to compress the engaging elements together and fix the position of the bracket 50 relative to the slat wall S. Although not illustrated, if desired, the outwardly facing surface of the thumbscrew knob may incorporate some padding or felt so the guitar body is not damaged by direct contact.

FIGS. 8-10 depict a further embodiment of the invention with a one piece bracket 90 having central hub 92 with strap pin engaging arms 94 and 96 of different length and disposed at an obtuse angle relative to each other in the plane of the hub. A small knurled thumbscrew 98 projects from the front of the hub which is mounted to a pin 100 affixed to and projecting outwardly from the base plate 102. In this embodiment, the unclamped/rotatable- clamped/anti-rotation member 104 comprises two same-sized, hollow, cup-like structures having confronting annularly disposed teeth 106. The teeth are disposed on the annular periphery of the cup lip so when compressed into a confronting relationship, engage to provide for non-rotation. The confrontable lips of the cup-like structures are compressably interlocked by turning of thumbscrew 98 on the threaded pin 100 which projects orthogonally through the assembly to clampingly engage bracket 90 in a fixed position.

Figure 6:
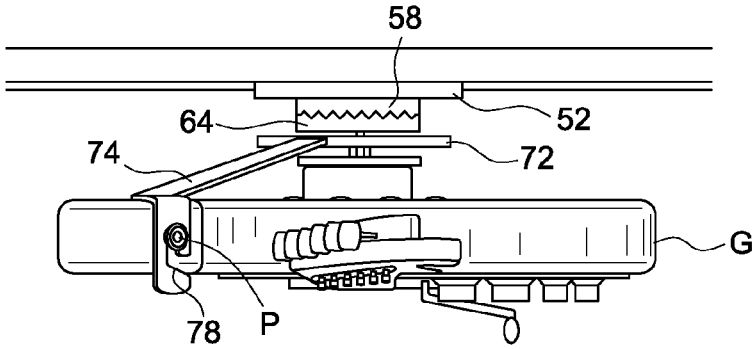
FIG. 6 is a top view of the embodiment of FIG. 4 in assembly with a guitar
Figure 7:
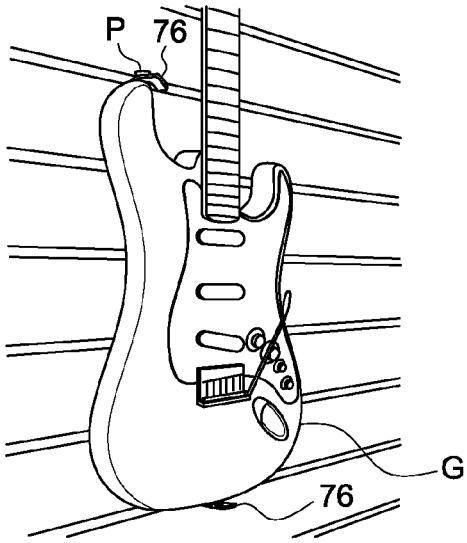
FIG. 7 is a perspective view of a guitar vertically mounted to a slat wall with the embodiment of FIG. 4

In FIGS. 11 and 12 direct wall mounting embodiments 110 of the invention are illustrated. In these embodiments, generally for display of instruments at home, the underlying base plate is screwed directly into a wall (not illustrated) and covered with a decorative escutcheon 112 of desired geometrical configuration, color, and material. The escutcheons 112, as described in connection with the first disk element 58 of FIG. 6, may incorporate the rotational restricting element to co-act with a corresponding structure attached to the back of the hub of the bracket arm 114 when compressed upon rotation of the thumbscrew 116.

FIG. 13 illustrates a further embodiment of the invention 120 mounted directly to wall W. This embodiment is designed specifically to conform to a guitar with a back pin, e.g., Gibson SG. In this version, the finger 124 at the end of the arm 122 curves back to form a hook that features the pin receiving slot on its outward face and located to receive the associated, rear facing guitar pin.

The advantages of employment of the necked string instrument support should be evident. In particular, it will be seen that the link of this invention securely and unobtrusively retains the guitar by supporting the body rather than the neck, while providing flexibility for display and the like. Furthermore, the advantages of the novel slat wall display mounting assembly suggested herein should also be evident to persons having ordinary skill in the art.

Modifications and alterations may be used in the design and manufacture of a necked string instrument support particularly suited for mounting and displaying guitars and the like of the present invention without departing from the spirit and scope thereof.

What is claimed is:

1. A supporting bracket for an article with spaced, projecting retaining pins, comprising:

a mounting base for attachment to a selected structural surface, a first element of a interlockable rotatable member having a inward face and an outward face, the outward face incorporating the first member of a cooperating interlocking structure, said first element being connected to and overlying the mounting base;

a second element of a interlockable rotatable member having a inward face and an outward face, the inward face incorporating the second member of a cooperating interlocking structure, said second element being interlockable with and overlying said first element;

a mounting bracket including a central hub, a pair of arms extending outwardly away from the hub where each arm includes a pin retaining opening, said mounting bracket being connected to the mounting bracket, the first element and the second element; in a manner to overlie the second element; and a compression element to apply compressive force to the central hub of the mounting bracket, the second element, the first element, and the mounting base in a manner to interlock the first and second elements and prevent their relative rotation.

2. The supporting bracket of claim 1 where the arms are dimensioned to receive and secure strap pins mounted to the body of a musical instrument having a neck.

3. The supporting bracket of claim 2 where the arms include outwardly projecting fingers and the pin retaining openings are slots.

4. The supporting bracket of claim 3 where projecting fingers include a covering to protect against damage to the body.

5. The supporting bracket of claim 4 where the pin retaining openings further include a pin latch.

6. The supporting bracket of claim 3 where the mounting base includes a slat wall mounting engagement lip.

7. The supporting bracket of claim 6 where the connection between the mounting member and the first and second elements of the interlockable rotatable members and the central hub comprises an elongated threaded pin onto which the compression element is threadably affixed to allow for rotation between a compressive state and an uncompressed state.

8. The supporting bracket of claim 7 where the first element of the interlockable rotatable member is a round disk the a first element of the interlockable rotatable member is a disk and the second element of the interlockable rotatable member is a round disk dimensioned to overlie the first disk where the second member is engagable with the first disk in the compressed state.

9. The supporting bracket of claim 8 where the first and second disks include teeth formed on the confronting surfaces thereof and the teeth interengage in the compressed state and disengage in the uncompressed state.

10. The supporting bracket of claim 9 where the teeth are radially disposed on the confronting disk surfaces.

11. The supporting bracket of claim 10 where the mounting bracket is planar and the arms are of different lengths.

12. The supporting bracket of claim 10 where the compression element is a thumbscrew threadably attached to a pin projecting orthogonally from the mounting base.

13. The supporting bracket of claim 3 where the arms have different lengths.

14. A hanger bracket for support of a necked string instrument having strap buttons, comprising:

a base plate member attachable to a select surface;

an instrument retaining member including slots dimensioned to receive and retain the strap buttons;

a pin having a first end connected to the base member and a second threaded end, said instrument retaining member being mounted on the pin between the first and second ends;

a clamping member threaded on the pin and movable axially therealong between a first position and a second position;

a first element of a interlockable member having a inward face and an outward face, the outward face incorporating the first member of a cooperating interlocking structure, said first element associated with the base plate member; and a second element of a interlockable member having a inward face and an outward face, the inward face incorporating the second member of a cooperating interlocking structure, said second element associated with the instrument retaining member;

wherein said first and second elements are rotatable about the pin and permit relative rotation of the base member and instrument retaining member when the clamping member is in the first position and where said first and second elements are interlocked when said clamping member is in the second position to thereby prevent rotation of the base plate member relative to the instrument retaining member.

15. The hanger bracket of claim 14 where the first interlockable element is a discrete disk and the second interlockable element is a discrete disk and the clamping member is a thumbscrew.

16. The hanger bracket of claim 14 where the instrument retaining member comprises a pair of substantially diametrically projecting arms where each of the arms includes slotted prongs to receive and retain the strap buttons and where the length between the slotted prongs is adjustable.

17. The hanger bracket of claim 14 further comprising an escutcheon to conceal the base plate member attached to the select surface.

18. The method of displaying a guitar using a hanger bracket according to claim 14.

19. The method of displaying a guitar on a slat wall using a hanger bracket according to claim 6.

* * * * *